US010020087B1

(12) United States Patent
Kozhukh

(10) Patent No.: US 10,020,087 B1
(45) Date of Patent: Jul. 10, 2018

(54) HIGHLY REFLECTIVE CRYSTALLINE MOSAIC NEUTRON MONOCHROMATOR

(71) Applicant: Michael Kozhukh, Mountain View, CA (US)

(72) Inventor: Michael Kozhukh, Mountain View, CA (US)

( * ) Notice: Subject to any disclaimer, the term of this patent is extended or adjusted under 35 U.S.C. 154(b) by 481 days.

(21) Appl. No.: 14/692,570

(22) Filed: Apr. 21, 2015

(51) Int. Cl.
*G21K 1/06* (2006.01)

(52) U.S. Cl.
CPC ..... *G21K 1/062* (2013.01); *G21K 2201/062* (2013.01); *G21K 2201/067* (2013.01)

(58) Field of Classification Search
CPC ..... G21K 1/062; G21K 2201/062; G21K 2201/067; G01N 2223/331
See application file for complete search history.

(56) References Cited

U.S. PATENT DOCUMENTS 4,842,665 A * 6/1989 Taguchi ..... G21K 1/06 156/155
2008/0117511 A1* 5/2008 Chen ..... G21K 1/06 359/574

OTHER PUBLICATIONS

Courtois, P., B. Hamelin, and K. H. Andersen. "Production of copper and Heusler alloy Cu 2 MnAl mosaic single crystals for neutron monochromators." Nuclear Instruments and Methods in Physics Research Section A: Accelerators, Spectrometers, Detectors and Associated Equipment 529.1 (2004): 157-161.*

Miyake, Y., et al. "Hot pressing of Ge crystals toward a reflection-plane-selective neutron monochromator." Journal of Physics: Conference Series. vol. 200. No. 11. IOP Publishing, 2010.*

M.L. Kozhukh, et al., Nuclear Instruments and Methods 213 (1983) 483-487, North-Holland Publising Company; Study Of Ge—Si Solid Solution Crystals by X-Ray Topography and Neutrom Difraction.

M. Kozhukh, et al., Gamma-ray focusing telescope based on high reflective Ge and Si mosaic crystals. Optics for EUV, X-Ray, and Gamma-Ray Astronomy II, edited by Oberto Citterio, Stephen L. O'Dell, Proc. of SPIE vol. 5900, 590017-1 through 590017-9, (2005).

M.L. Kozhukh, Low-temperature conduction in germanium with disorder caused by extended defects, J. Phy Coodent Matter 5 (1993) 2351-2376, Printed in the UK: issue 15.

* cited by examiner

*Primary Examiner* — Wyatt Stoffa
(74) *Attorney, Agent, or Firm* — Lowenstein Sandler LLP

(57) ABSTRACT

A crystal monochromator is manufactured by heating a crystal having an original thickness to a temperature of over about 850° C. The crystal is compressed for a duration of approximately 1-5 minutes with a force of about 5-10 metric tons while the crystal is maintained at the temperature of over about 850° C. to plastically deform the crystal along an axis, wherein the compressing causes a plastic deformation of about 0.5%-1.5% of the original thickness. The crystal may be sliced to form crystal monochromators having a mosaicity of between about 15-28 arcminutes and a slow neutron reflectivity of over 70% at a rocking curve peak.

23 Claims, 8 Drawing Sheets

HIGHLY REFLECTIVE CRYSTALLINE MOSAIC NEUTRON MONOCHROMATOR

FIELD OF TECHNOLOGY

Embodiments of the present invention relate to slow neutron optics, and more particularly to flat surface and focusing crystalline mosaic monochromators with high reflectivity for use in slow neutron optics.

BACKGROUND

Monochromators are optical devices used transmit a narrow band of wavelengths of light or other radiation. In X-ray, gamma-ray and neutron optics, crystal monochromators are used to define wave conditions (e.g., to select a defined wavelength of radiation to be used).

Perfect crystals exhibit a high reflectivity of close to 100% but a very low mosaicity. In particular, perfect crystals typically have a mosaicity of only a few (e.g., 1-2) arcseconds.

The known phenomenon of X-ray and slow neutron Bragg diffraction from perfect single crystals (single crystals with high structure quality), particularly, Si, Ge, $SiO_2$, is employed for monochromatization of these types of nuclear radiation. The perfect crystals reflect the radiation in a very narrow angular range of several arcseconds at a specific Bragg angle. Thus, despite a very high level of spectral resolution achieved with the use of diffraction from perfect crystals, there is a drastic decrease of reflected nuclear radiation intensity relative to incident radiation. This low reflectivity makes employment of perfect single crystal monochromators unacceptable for many applications in slow neutron optics.

A neutron beam typically has a divergence of about 10-20 arcminutes. Accordingly, when perfect crystals are used as monochromators for neutron optics, only a small fraction of the total neutron beam is reflected off of the monochromator. For example, a perfect crystal with a mosaicity of 2 arcseconds would only reflect about 1.7% of the total flux of the neutron beam assuming a 100% reflectivity. Accordingly, perfect crystals are not acceptable for monochromators in many applications.

For over 50 years attempts have been made by many organizations to create Ge crystal monochromators that have both a high mosaicity and a slow neutron high reflectivity. However, theory and empirical study shows that changes to a crystal structure that cause increases in mosaicity also cause decreases in reflectivity. The imperfect crystal diffraction theory states that increases in mosaicity are accompanied by corresponding decreases in peak reflectivity. This phenomenon has also been observed experimentally. For example, this phenomenon was shown for mosaic Ge crystals in Kozhukh, *Low-temperature conduction in germanium with disorder caused by extended defects*, J. Phys. Condens. Matter 5, pp. 2351-2376 (1993). FIG. 22 of *Low-temperature conduction in germanium with disorder caused by extended defects* shows a peak reflectivity of about 40% for a Ge crystal with a mosaicity of about 20-30 arcminutes. To date all attempts to create Ge slow neutron crystal monochromators with both a high reflectivity and a desired mosaicity have been unsuccessful. Moreover, it was generally viewed as not possible to produce such slow neutron Ge crystal monochromators.

BRIEF DESCRIPTION OF THE DRAWINGS

Embodiments of the present invention are illustrated by way of example, and not by way of limitation, in the figures of the accompanying drawings in which like references indicate similar elements.

DETAILED DESCRIPTION

Figure 1:
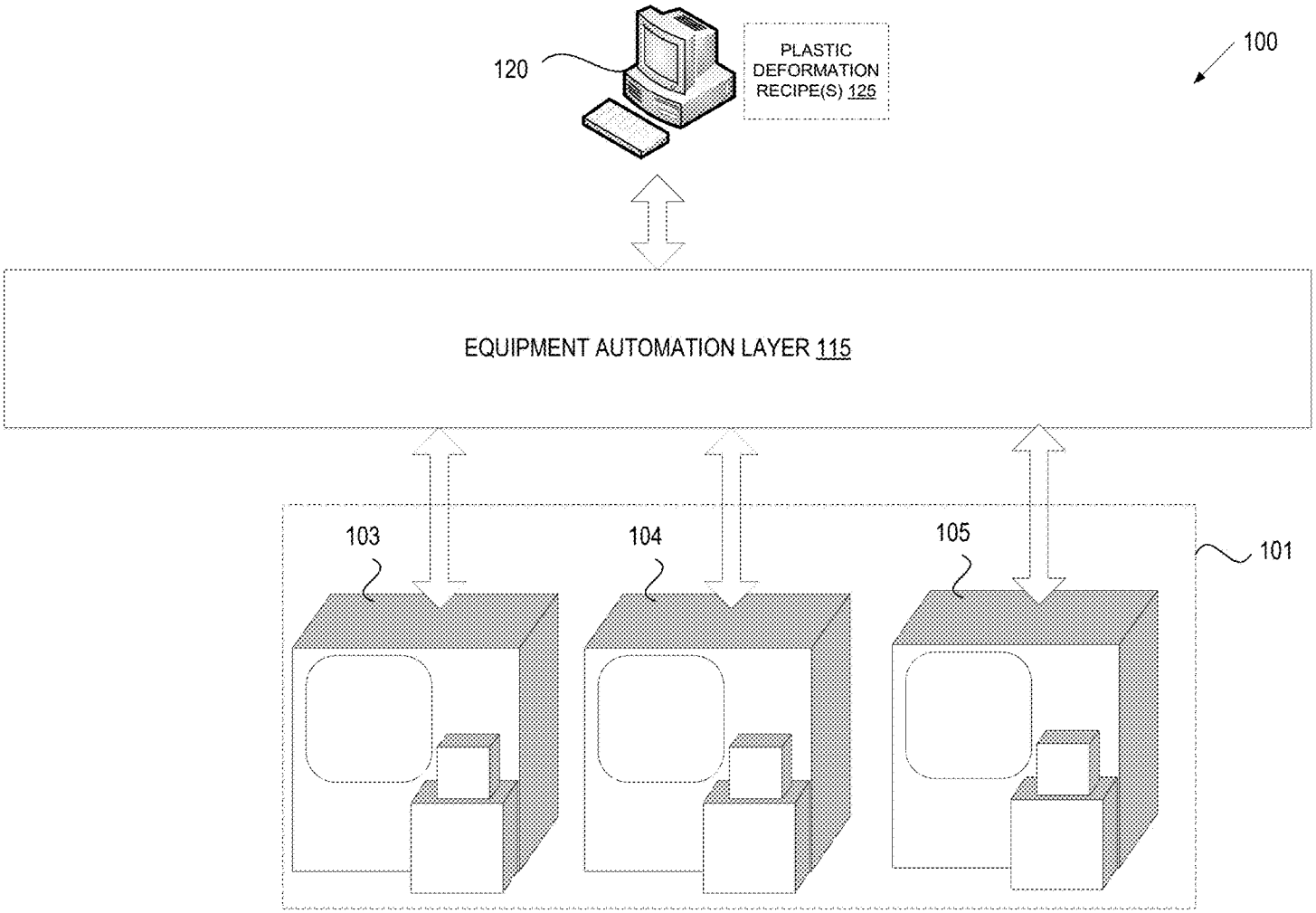
FIG. 1 illustrates an exemplary architecture of a manufacturing system, in accordance with one embodiment of the present invention.

A crystal monochromator is a device in nuclear optics (e.g., in slow neutron, gamma ray and X-ray optics) used to select a defined wavelength of radiation. Crystal monochromators operate through the diffraction process according to Bragg's law. Embodiments of the invention are directed to a process for manufacturing a crystalline mosaic neutron monochromator, and to a highly reflective crystalline mosaic neutron monochromator created using such a manufacturing process. Embodiments are also directed to a composite monochromator that has areas with multiple different mosaicities, and to a process for manufacturing such a composite monochromator. Diffraction principles are the same for X-ray, gamma-ray and slow neutron crystal optics. Accordingly, the composite monochromator may be used for X-ray, gamma-ray and slow neutron crystal optics.

Heretofore, attempts to create Ge crystal monochromators with both a medium to high mosaicity and a high slow neutron reflectivity have been unsuccessful. Mosaicity is a measure of the spread of crystal plane orientations (in small blocks). A mosaic crystal is an idealized model of an imperfect crystal consisting of numerous small perfect crystals (crystallites or blocks) that are randomly (or pseudo-randomly) disoriented. Empirically, mosaicity of a crystal can be determined by measuring width of diffraction as represented in a slow neutron rocking curve at half maximum (half of rocking curve peak).

A rocking curve produces observed reflected radiation from mosaic blocks, where there are mosaic blocks with planes that are not perfectly parallel to other mosaic blocks. To generate a rocking curve, a neutron detector is set at two times a specific Bragg angle, and a sample (e.g., crystal monochromator) is rotated around the Bragg angle. A perfect crystal will produce a very narrow peak, observed only when the crystal is properly tilted so that the crystallographic direction is parallel to diffraction vectors of the perfect crystal. Mosaicity creates a disruption in the perfect parallelism of atomic planes, which results in a broadening of the rocking curve. The peak of the slow neutron rocking curve shows a value of the maximum reflectivity at the Bragg angle.

The manufacturing process described herein plastically deforms a starting perfect (or near-perfect) crystal at high temperature by changing its crystal structure. The plastic deformation is carefully controlled to cause the crystal monochromator to have a desired mosaicity while maintaining a high reflectivity. Resultant crystal monochromators manufactured in accordance with embodiments described herein have a combination of medium to high mosaicity and high reflectivity that theory and empirical study have heretofore shown to not be possible.

In one embodiment, a crystal having an original thickness (e.g., 40-50 mm thick) is heated to a target temperature of over about 850° C. The crystal is maintained at the target temperature for over an hour to ensure that the crystal has a uniform temperature (across the crystal's vertical and horizontal cross sections). The crystal is then compressed for a duration of approximately 1-5 minutes with a force of about 5-10 metric tons while the crystal is maintained at the target temperature to plastically deform the crystal along an axis coincident with the crystal's axis (which may be a [1,1,1] axis normal to the (1,1,1) plane of the crystal). The compressing causes a plastic deformation of about 0.5%-1.5% of the original thickness. A top and bottom of the crystal may then be trimmed perpendicular to the axis to remove non-uniformly damaged regions of the crystal. A remainder of the crystal (e.g., central part of the crystal) may then be sliced perpendicular to the axis to form multiple crystal monochromators (multiple flat or focusing crystalline mosaic slow neutron monochromators), wherein each of the crystal monochromators has a mosaicity of between about 15-28 arcminutes and a slow neutron reflectivity of over 70% at a rocking curve peak.

Embodiments also provide a manufacturing process to create composite monochromators that have two or more different mosaicity values in different areas of the monochromator's surface. Such composite monochromators may have a first region with a first mosaicity and a second region with a substantially different second mosaicity. For example, a composite monochromator may have a first region that has a near perfect crystal structure with a mosaicity of less than 1 arcminute and a second region with a plastically deformed crystal structure with a mosaicity of up to about 40 arcminutes. Composite monochromators may also have a continuous gradient of mosaicity along one or more axis. One example composite monochromator has a near perfect crystal structure at a center and a continuous radial gradient of mosaicity increasing with distance from the center.

When the terms "about" and "approximately" are used herein, these are intended to mean that the nominal value presented is precise within ±10%.

Embodiments are discussed with reference to use of a Ge crystal to produce a crystal monochromator. However, it should be understood that other single crystal materials such as Si, $SiO_2$, Be, C, Cu, etc. can be also used for the manufacture of composite monochromators that have multiple areas with different mosaicities. Additionally, embodiments are discussed with reference to crystal monochromators used for slow neutron optics. However, it should be understood that the composite monochromators discussed in embodiments herein may also be manufactured and used for X-ray optics applications and Gamma ray optics applications.

FIG. 1 illustrates an exemplary architecture of a manufacturing system 100, in accordance with embodiments of the present invention. The manufacturing system 100 may be a crystal monochromator manufacturing system. In one embodiment, the manufacturing system 100 includes processing equipment 101 connected to an equipment automation layer 115. The processing equipment 101 may include a surface preparation device 103, a cutting device 104 and/or a furnace 105. The manufacturing system 100 may further include one or more computing device 120 connected to the equipment automation layer 115. In alternative embodiments, the manufacturing system 100 may include more or fewer components. For example, the manufacturing system 100 may include manually operated (e.g., off-line) processing equipment 101 without the equipment automation layer 115 or the computing device 120.

Surface preparation device 103 may be a grinder, mill or computer numerical control (CNC) machine. Grinders are machines having an abrasive disk that grinds and/or polishes a surface of the article. Grinders may include a polishing/grinding system such as a rough lapping station, a chemical mechanical planarization (CMP) device, and so forth. The grinders may include a platen that holds a substrate and an abrasive disk or polishing pad that is pressed against the substrate while being rotated. Grinders grind a surface of a crystal to decrease a roughness of crystal and/or to cause the crystal to have a uniform thickness (e.g., cause the top and bottom of the crystal to be parallel planes). The grinders may grind/polish the crystal in multiple steps, where each step uses an abrasive pad with a slightly different roughness and/or a different slurry (e.g., if CMP is used). For example, a first abrasive pad with a high roughness may be used to quickly grind down the crystal to a desired thickness, and a second abrasive pad with a low roughness may be used to polish the crystal to a desired roughness.

In some embodiments, the top and/or bottom of the crystal is machined to have a specified surface profile. A mill or CNC machine may be used to machine the top and bottom to cause them to have the specific surface profile. The mill may be a three axis mill that an operator may control to shape a surface of the crystal. A CNC machine is an automation tool that reads commands from an electronic file created from a computer aided design (CAD) system. The CNC machine may include one or more of a mill, a lathe, a drill, a plasma cutter, a laser cutter, and so on. The CNC machine may execute instructions from the electronic file to precisely cut the desired surface profile into the top and bottom of the crystal using a computer controlled mill, lathe, laser, cutter, drill, etc.

Cutting device 104 is a device used to cut, slice and/or trim the crystal. The cutting device may be a mechanical saw, a plasma cutter, a laser cutter, and so on. In one embodiment, cutting device 104 is a CNC machine. In one embodiment, surface preparation device 103 and cutting device 104 are a single machine.

Furnace 105 is a machine designed to heat articles such as crystal ingots. Furnace 105 includes a thermally insulated chamber, or oven, capable of applying a controlled temperature on articles (e.g., crystals) inserted therein. In one embodiment, the chamber is hermitically sealed. Furnace 105 may include a pump to pump air out of the chamber, and thus to create a vacuum within the chamber. Furnace 105 may additionally or alternatively include a gas inlet to pump gasses (e.g., inert gasses such as Ar or $N_2$) into the chamber.

Furnace 105 may be a simple furnace having a temperature controller that is manually set by a technician during processing of crystal ingots. Furnace 105 may also be an off-line machine that can be programmed with a process recipe. The process recipe may control ramp up rates, ramp down rates, process times, temperatures, pressure, gas flows, and so on. Alternatively, furnace 105 may be an on-line automated furnace that can receive process recipes from computing devices 120 such as personal computers, server machines, etc. via an equipment automation layer 115. Furnace 105 includes a press that compresses crystals placed therein. A force applied by the press may be controlled manually or in accordance with a process recipe.

The equipment automation layer 115 may interconnect some or all of the manufacturing machines 101 with computing devices 120, with other manufacturing machines, with metrology tools and/or other devices. The equipment automation layer 115 may include a network (e.g., a location area network (LAN)), routers, gateways, servers, data stores, and so on. Manufacturing machines 101 may connect to the equipment automation layer 115 via a SEMI Equipment Communications Standard/Generic Equipment Model (SECS/GEM) interface, via an Ethernet interface, and/or via other interfaces. In one embodiment, the equipment automation layer 115 enables process data (e.g., data collected by manufacturing machines 101 during a process run) to be stored in a data store (not shown). In an alternative embodiment, the computing device 120 connects directly to one or more of the manufacturing machines 101.

In one embodiment, some or all manufacturing machines 101 include a programmable controller that can load, store and execute process recipes. The programmable controller may control temperature settings, gas and/or vacuum settings, time settings, etc. of manufacturing machines 101. The programmable controller may include a main memory (e.g., read-only memory (ROM), flash memory, dynamic random access memory (DRAM), static random access memory (SRAM), etc.), and/or a secondary memory (e.g., a data storage device such as a disk drive). The main memory and/or secondary memory may store instructions for performing heat treatment processes described herein.

The programmable controller may also include a processing device coupled to the main memory and/or secondary memory (e.g., via a bus) to execute the instructions. The processing device may be a general-purpose processing device such as a microprocessor, central processing unit, or the like. The processing device may also be a special-purpose processing device such as an application specific integrated circuit (ASIC), a field programmable gate array (FPGA), a digital signal processor (DSP), network processor, or the like. In one embodiment, programmable controller is a programmable logic controller (PLC).

In one embodiment, the manufacturing machines 101 are programmed to execute recipes that will cause the manufacturing machines to machine a top and/or bottom of a crystal, heat and plastically deform the crystal, and/or cut the crystal. In one embodiment, the manufacturing machines 101 are programmed to execute recipes that perform operations of a multi-step process for manufacturing a crystal monochromator, as described with reference to FIG. 6. The computing device 120 may store one or more plastic deformation recipes 125 that can be downloaded to the manufacturing machines 101 to cause the manufacturing machines 101 to manufacture crystal monochromators in accordance with embodiments of the present invention.

Figure 2A:
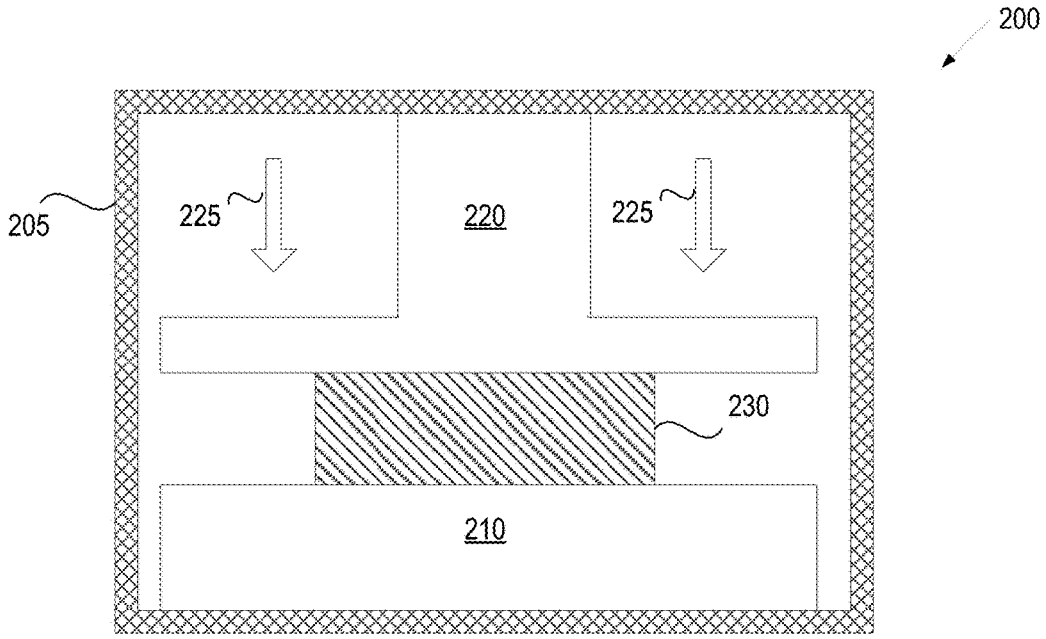
FIGS. 2A-2C illustrate embodiments of a furnace used to plastically deform crystals.
Figure 2B:
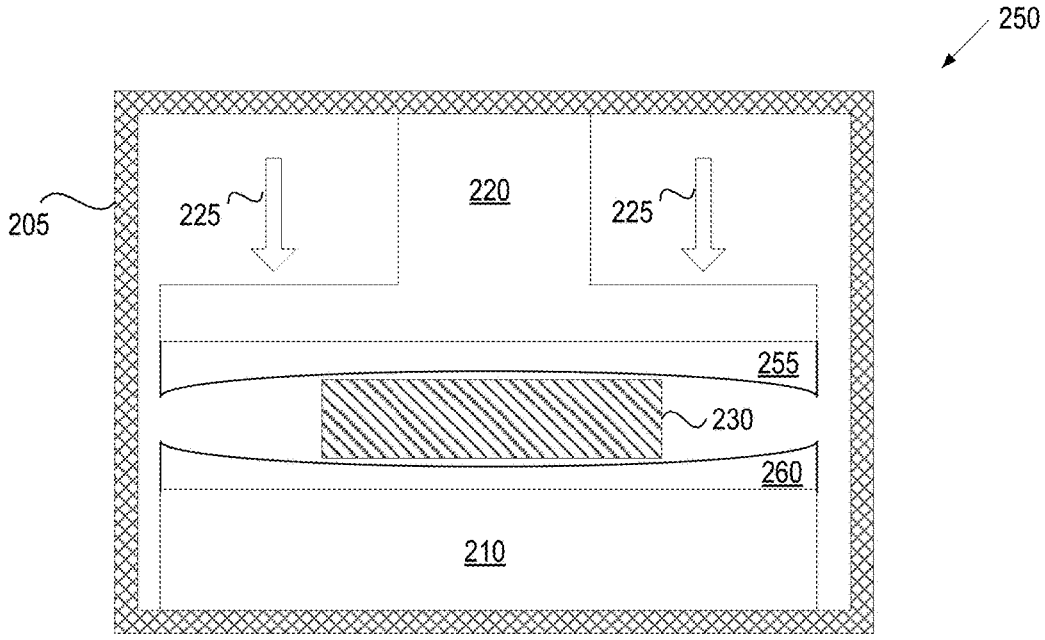
Figure 2C:
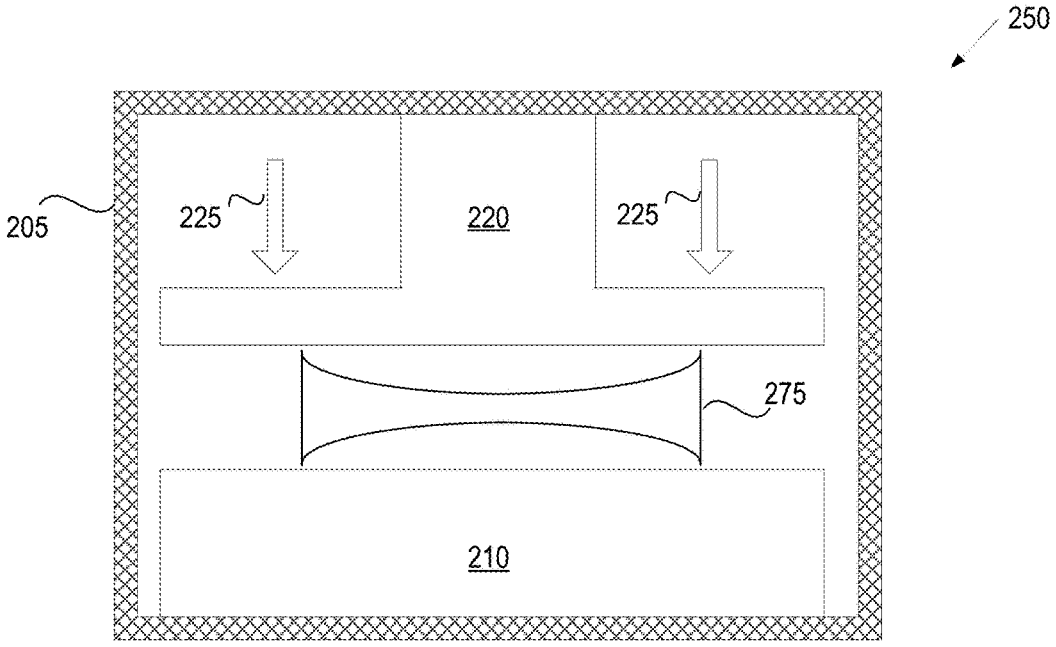

FIGS. 2A-2C illustrate embodiments of a furnace used to plastically deform crystals. FIG. 2A illustrates a furnace 200 used to plastically deform a crystal ingot 230 uniformly. The crystal ingot 230 may have a diameter of around 70 mm and a thickness of around 40-50 mm. In one embodiment, the crystal ingot 230 is a Ge crystal ingot. In a further embodiment, the crystal ingot 230 is initially a perfect crystal ingot that has been cut from a larger grown Ge crystal ingot. As used herein, the terms near perfect crystal and approximately perfect crystal refer to a crystal with an approximately perfect crystal structure that exhibits a mosaicity of less than 1 arcminute. The term perfect crystal is used to refer to a crystal structure with a mosaicity of less than 10 arcseconds.

The furnace 200 includes a thermally insulated chamber 205 that houses a press including a substrate support 210 a plunger 220 (e.g., a hydraulic plunger). All of the plunger 220 or a face of the plunger 220 that contacts the crystal ingot may be a metal such as steel, tungsten, a W—Co alloy, etc. Additionally all of the substrate support or a face of the substrate support 210 that contacts the crystal ingot may be a metal such as steel, tungsten, a W—Co alloy, etc.

The crystal ingot 230 is placed onto the substrate support 210. The internal chamber of the furnace 250, including the substrate support 210, crystal ingot 230 and plunger 220, is then heated to a target temperature of about 850° C. to about 870° C. In one embodiment, the internal chamber is heated to the target temperature over a period of up to 7-8 hours. Once the chamber has reached the target temperature, the chamber may be maintained at the target temperature for about 1-1.5 hours to ensure that the crystal ingot 230 has a specific uniform temperature. Differences in temperature may cause the crystal ingot to crack during compression and/or may cause the crystal ingot to have a random or uncontrolled non-uniform mosaicity distribution. The plunger 220 and substrate support 210 may also attain uniform temperature during this time.

Once the crystal ingot 230 has a uniform target temperature of about 850-870° C., the crystal becomes less fragile and more pliable. This reduces a chance that the crystal will crack during compression and enables the crystal to be plastically deformed in a controlled manner. The plunger 220 applies a compressive force 225 to the crystal ingot 230, squeezing the heated crystal ingot between the plunger 220 and the substrate support 210. In one embodiment, the crystal ingot is machined prior to compression to ensure that the crystal ingot has a uniform thickness. Differences in thickness can cause a different amount of force to be applied to different regions of the crystal ingot, which in turn can cause those regions to have different mosaicities. By polishing a top and bottom of the crystal ingot, a manufacturer may ensure that an equal compressive force will be applied across the crystal ingot 230.

In one embodiment, the crystal ingot 230 is compressed for a duration of about 1-5 minutes at a force of about 5-10 metric tons. The force should be sufficient to cause the crystal ingot to plastically deform so that it has a change (e.g., a plastic deformation) of about 0.5%-1.5% of its original thickness. In other words, the crystal ingot should be compressed so that after compression the thickness of the crystal ingot is decreased by about 0.5%-1.5% along an axis. In one embodiment, the crystal ingot has an initial thickness of 4.00 cm and a final thickness of about 3.96 cm after plastic deformation. In one embodiment, the crystal ingot has a diameter of about 7 cm. In one embodiment, the crystal ingot has a planar orientation of (1,1,1), and is compressed along a [1,1,1] axis that is orthogonal to the (1,1,1) planar orientation.

Crystal mosaic monochromators may reflect slow neutrons in the angular range of 1-40 arcminutes (depending the value of crystal mosaicity) around a Bragg angle. Ge crystalline mosaic monochromators manufactured in accordance with embodiments described herein have a mosaicity that is near the 20 arcminute beam divergence of a slow neutron beam and a peak rocking curve reflectivity for a slow neutron beam of up to 89% (e.g., 89% reflectivity at the Bragg angle). Crystalline mosaic monochromators have an increased integral slow neutron reflectivity that is on the order of a hundred times greater than that of perfect crystalline monochromators. However, such crystalline mosaic monochromators decrease the spectral resolution (energy resolution) with increase of their mosaicity value and, thus, also have limitations of their applications. For example, a perfect crystal monochromator may have a peak reflectivity of near 100%. Accordingly, even the improved crystalline mosaic monochromators described in embodiments still have a lower neutron rocking curve peak reflectivity that is lower than that of a perfect crystal monochromator. Accordingly, composite crystalline monochromators are described in embodiments herein.

A composite crystalline monochromator includes at least two regions with a different mosaicity and peak rocking curve reflectivity. In one embodiment, a first region has a near perfect crystal structure and another region has crystalline mosaic structure. Such composite monochromators provide both the benefits of a high spectral resolution when the region of the monochromator with the near perfect crystal structure is used and a high integral reflectivity of radiation from another part of the crystal that has the mosaic crystal structure when this region is used. For example, the first region may be used for a first application (without using the second region), and the second region may be used for a different second application (without using the first region). Such design allows extending possible applications for crystalline monochromators, simplifies their use and reduces the cost of experiments. To achieve high spectral resolution, nuclear radiation (X-rays, slow neutrons and/or gamma rays) may be incident on and reflected from the perfect part of the crystalline composite monochromator. To arrange that experimentally, the monochromator may be moved across/up-down a radiation beam to expose the perfect crystal region to the radiation beam. Alternatively, the part of the monochromator with the mosaic structure may be shielded from the incident radiation by absorption filters from materials with high atomic number (e.g., Z for X-Rays or from Cd, B, Li or rare earth elements/alloys for slow neutrons).

For applications that require high integral reflectivity of the radiation, both the perfect region and the mosaic region of the crystalline composite monochromator can be exposed to the radiation simultaneously. The contribution of the perfect crystal region to the diffracted beam is insignificant in comparison with the contribution of the crystal region with the higher mosaicity. In other embodiments, the composite monochromator may have two or more different regions with mosaic structures having different mosaicity. The composite monochromators may have discrete regions with different mosaicity, or may have a continuous gradient of changing mosaicity.

Composite crystalline monochromators can be produced by plastic deformation of a single crystal along one axis by compression at high temperature. FIG. 2B illustrates a furnace 250 used to heat and plastically deform a crystal ingot 230 non-uniformly in order to manufacture a crystalline composite monochromator. Furnace 250 is substantially similar to furnace 200. However, furnace 250 additionally includes an upper die 255 and a lower die 260 with non-flat surfaces. The upper die 255 and lower die 260 each have a surface profile in which one or more regions of the upper die and lower die are different than other regions. These different (e.g., thicker) regions will cause a greater force to be applied to a portion of the crystal that contact the thicker regions. The upper and lower die 255, 260 may be removed from the furnace 250, and may be replaced with other die having different surface profiles. In alternative embodiments, the surface profiles may be machined directly into the surface of the plunger 220 and the surface of the substrate support 210. It should be noted that the difference in thickness between the different regions of the upper and lower die 255, 260 may be minute (e.g., on the order of $10^{-3}$ or $10^{-4}$ meters), and are exaggerated in FIG. 2B for illustration. In one embodiment, the surface profile of the upper die 255 is the same as the surface profile of the lower die 260.

Many different surface profiles may be used for the upper and lower die 255, 260. Each surface profile may cause a different distribution of force over the crystal ingot 230 during high temperature plastic deformation, thus causing different patterns of final mosaicity across a surface of a manufactured crystal monochromator.

Figure 3A:
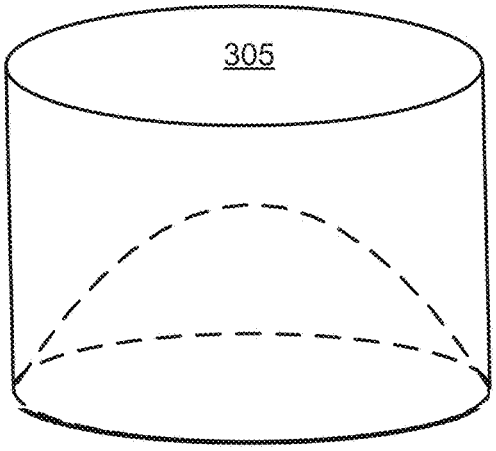
FIGS. 3A-3C illustrate various surface profiles of die used to create composite monochromators, in accordance with embodiments of the present invention.
Figure 4A:
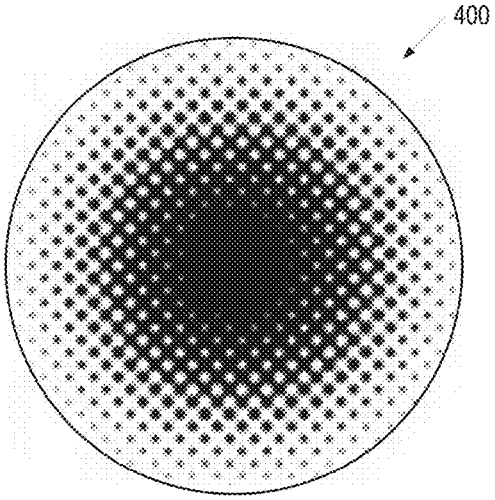
FIGS. 4A-4C illustrate composite monochromators manufactured using die illustrated in FIGS. 3A-3C.
Figure 3B:
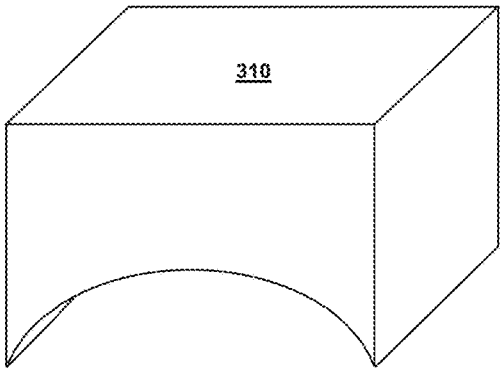
Figure 4B:
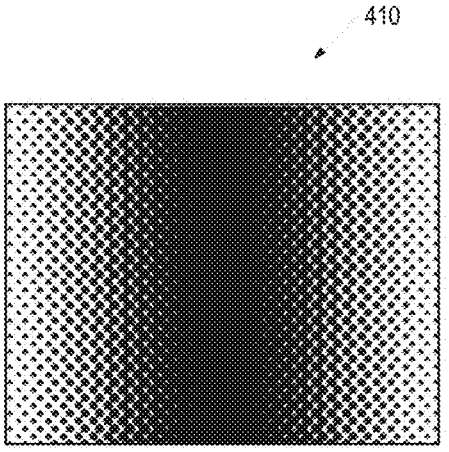
Figure 3C:
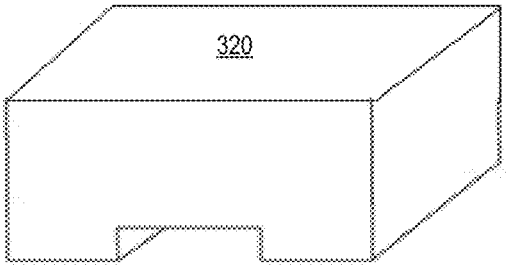
Figure 4C:
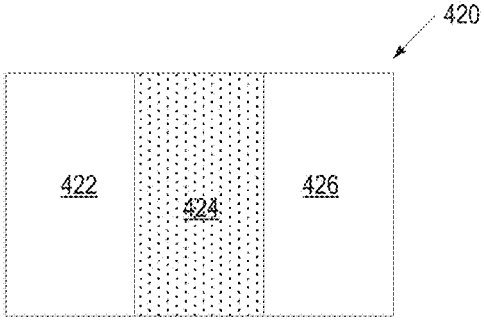

FIGS. 3A-3C illustrate various surface profiles of die used to create composite monochromators, in accordance with embodiments of the present invention. FIGS. 4A-4C illustrate composite monochromators manufactured using die illustrated in FIGS. 3A-3C.

FIG. 3A illustrates a die 305 with a bowl-shaped surface (surface with a concave shape that curves radially inward) profile that will cause a manufactured monochromator to have a continuous radial gradient of mosaicity increasing with distance from a center of the monochromator. FIG. 4A illustrates a composite monochromator 400 with a continuous radial gradient of mosaicity increasing with distance from a center of the monochromator generated using die 305. A center of the composite monochromator 400 has an approximately perfect crystal structure with a mosaicity of less than about 1 arcminute, and the outer perimeter of the composite monochromator 400 has a mosaicity of up to about 40 arcminutes. In one embodiment, the outer perimeter of the composite monochromator 400 has a mosaicity of 16-20 arcminutes. Such a composite monochromator may be used to focus, for example, gamma rays or a slow neutron beam in transmission mode.

FIG. 3B illustrates a die 310 with a halfpipe-shaped surface (surface with a u-shaped cross section that curves inward along one axis) profile that will cause a manufactured monochromator to have a continuous gradient of mosaicity increasing with distance from a center of the monochromator along one axis. FIG. 4B illustrates a composite monochromator 410 with a continuous linear gradient increasing with distance from a center of the composite monochromator 410 along a horizontal axis.

FIG. 3C illustrates a die 320 with a surface profile including two mesas separated by a trench. FIG. 4C illustrates a composite monochromator 420 manufactured using die 320. Composite monochromator 420 includes a center column 424 with a low mosaicity (e.g., below 1 arc minute in one embodiment) and two outer columns with a higher mosaicity of up to 40 arcminutes.

Many other configurations of composite monochromators with diverse distribution of mosaic areas may be manufactured. Those shown herein are for illustration purposes only, and should not be construed as limiting a scope of embodiments of the present invention.

FIG. 2C illustrates the furnace 250 used to plastically deform a non-flat crystal ingot 275. Another technique that may be used to manufacture composite monochromators having multiple different mosaicities is to machine a top and/or bottom surface of the crystal ingot that is to be compressed. In one embodiment, one surface of a crystal is polished and another surface of the crystal is shaped to a desired surface profile. In another embodiment, the top and bottom surfaces of a crystal are both shaped (e.g., with the same surface profile). As shown, the crystal ingot 275 is thinner at a center than at a periphery. This will cause a greater force to be applied to the crystal ingot at the periphery, which in turn will cause the periphery to have a greater plastic deformation and mosaicity than the center. Many different surface profiles may be machined into the crystal ingots to create different patterns of mosaicity. Alternatively, as discussed above, many different plunger shapes may be used to create different patterns of mosaicity.

It should be noted that the difference in thickness between the different regions of upper and lower surface of the crystal ingot 275 may be minute (e.g., on the order of $10^{-3}$ or $10^{-4}$ meters), and are exaggerated in FIG. 2C for illustration. In one embodiment, to have a "mosaic-perfect" structure in which one region has a near perfect crystal structure and another region has a mosaic crystal structure, the maximum crystal thickness change $T_c$ after plastic deformation by compressing should be less than or equal to the original thickness difference Δ of two crystal parts. If the Δ is equal to the change of crystal thickness $T_c$ after compression, the deformation will provide a maximum mosaic value for the composite "perfect-mosaic" monochromator.

If the change of crystal thickness $T_c$ after compression of the thicker part of the crystal is more than Δ, the final crystal structure in the originally thin part of the crystal will not be perfect anymore. In such an instance, the originally thin region will also have mosaic structure, and its mosaicity will depend on a deformation value of this crystal part. That means the monochromator will have a structure of "small mosaicity-large mosaicity" in at least two parts. The mosaicity value in the originally "thin" part of the crystal will be smaller than one in the originally "thick" crystal part.

The ratio between original thickness differences of these two regions (e.g., of a Ge ingot) and an amount of plastic deformation after compression defines the ratio between mosaicity in these two parts of the monochromator (assuming the thickness changes after compressing plastic deformation are more than their original thickness difference). If the deformation value is much bigger than original thickness difference of the two regions, the mosaicity of both parts after deformation will be almost equal. The described technique can be employed for development of crystalline monochromators with anisotropic mosaicity. Such crystalline monochromators with created artificial anisotropy of mosaicity in two directions (both perpendicular to the direction of compressing) can be employed, for example, for monochromatization of slow neutron beams or X-ray beams that usually have different divergence in horizontal and vertical planes. An optimization of the mosaicity distribution in accordance with the beam divergence in vertical and horizontal planes will increase the monochromator reflectivity.

It should be noted that differences in thickness of the crystal to achieve diverse mosaicity also apply in embodiments to differences in thickness for the plunger and substrate support (or the die attached to the plunger and substrate support). Accordingly, either the plunger may be shaped or the die may be shaped. An inverse of the surface profile of the plunger and substrate support (or die thereon)

Figure 5A:
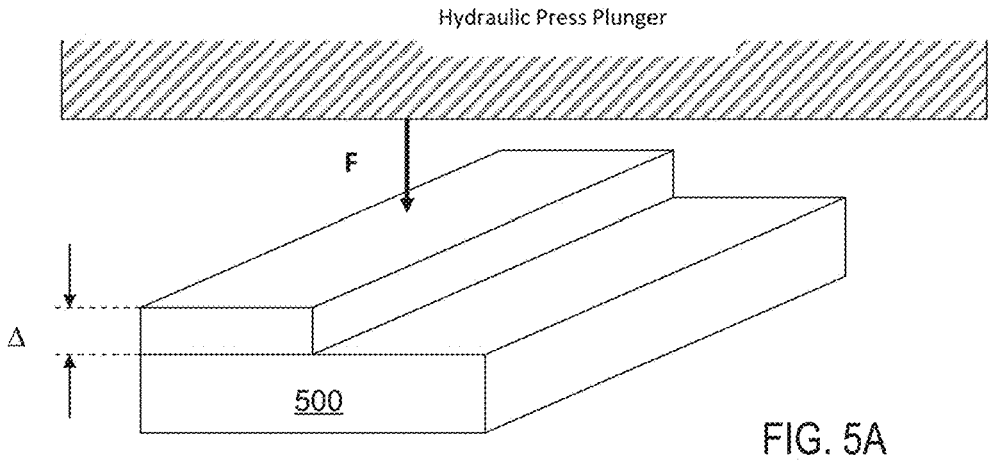
FIGS. 5A-5G illustrate different surface profiles of crystals that are to be compressed.

FIGS. 5A-5G illustrate different surface profiles of crystals that are to be compressed. FIG. 5A shows a crystal 500 with a surface profile of a single step along one axis. A thickness difference of Δ between a thicker portion of the crystal 500 and a thinner portion of the crystal 500 is shown. The thicker portion of the crystal will receive greater forces, and will have a higher mosaicity than the thinner portion of the crystal.

Figure 5B:
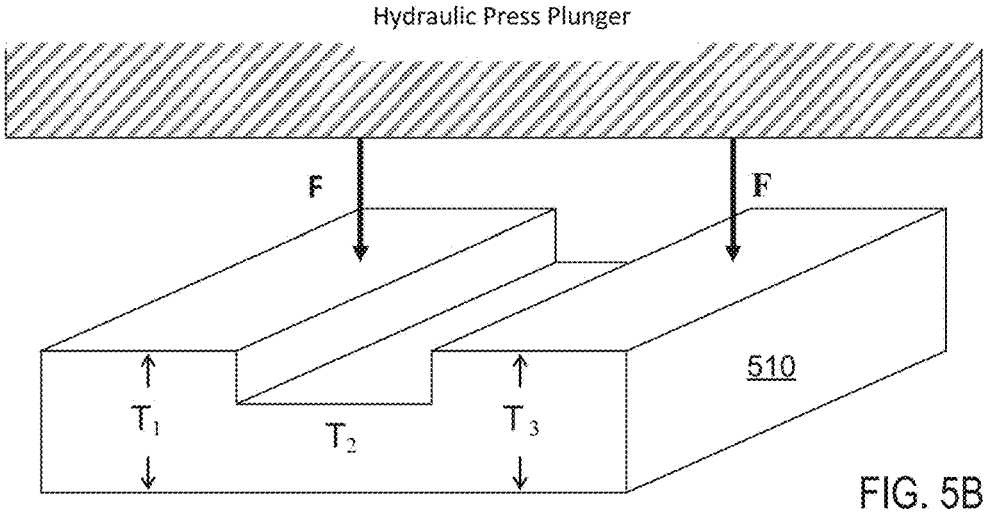

FIG. 5B shows another crystal 510 with a surface profile having two steps along one axis. Crystal 510 includes a first region having a thickness $T_1$, a second region having a thickness $T_2$ and a third region having a thickness $T_3$. Such a crystal 510, when compressed, will provide a crystal monochromator with a low central mosaicity along one axis and a higher mosaicity on both sides along the axis.

Figure 5C:
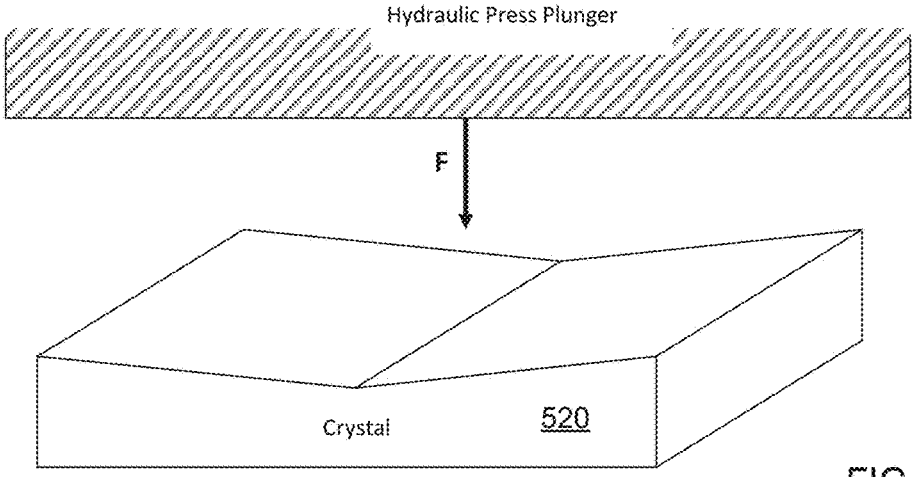

FIG. 5C shows a crystal 520 with a sloped surface profile along one axis. Such a shaped crystal may be used to produce crystalline monochromators with anisotropy of mosaicity and with continuous gradient of mosaicity in one direction. A similar technique can also be used to produce a continuous gradient of mosaicity in two directions (e.g., in two perpendicular directions). As shown in FIG. 5C, the crystal 520 has a continuous difference in thickness along a top surface, while a bottom surface is flat. Alternatively, the bottom surface may have the same surface profile as the top surface. This may cause compression forces to be more evenly distributed to the top and bottom of the crystal 520.

If the change in crystal thickness in the part undergoing plastic deformation is comparable to an original thickness gradient, the mosaicity will also have a gradient in the direction of the thickness gradient. For production of monochromators with anisotropic mosaicity in several crystal directions by compressing plastic deformation, crystals with different original shapes can be employed.

Figure 5D:
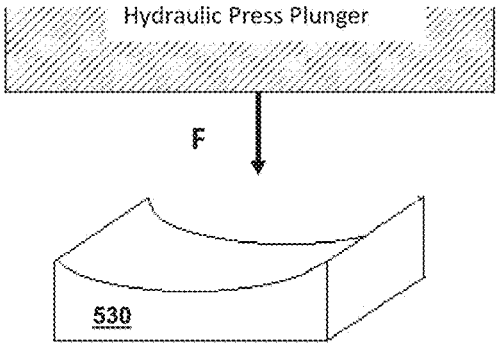

FIG. 5D shows a crystal 530 with a concave cylindrical surface with a positive gradient of thickness from a central axis to the sides of the crystal. This will produce a positive gradient of mosaicity from the middle of a manufactured crystalline mosaic monochromator to the perimeter of the crystalline mosaic monochromator along an axis. In one embodiment, the top and bottom of the crystal are machined to have the surface profile.

Figure 5E:
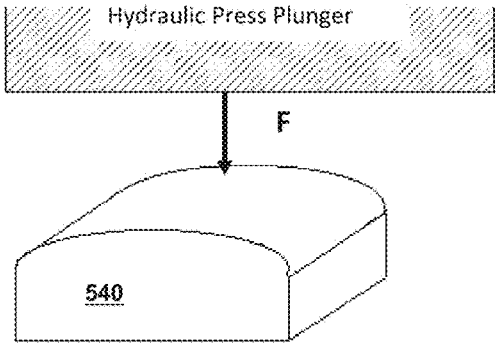

FIG. 5E shows a crystal 540 with a convex cylindrical surface with negative gradient of thickness from a central axis to the sides of the crystal. This will produce a negative gradient of mosaicity from the middle of a manufactured crystalline mosaic monochromator to the perimeter of the crystalline mosaic monochromator along an axis. In one embodiment, the top and bottom of the crystal are machined to have the surface profile.

Figure 5F:
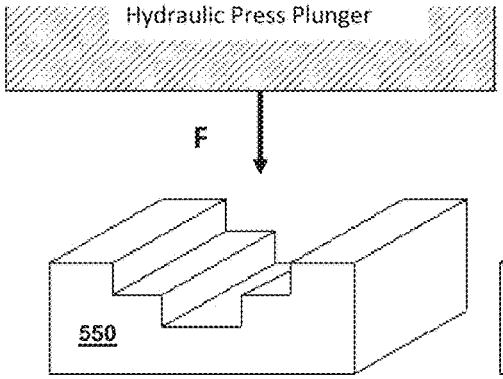
Figure 5G:
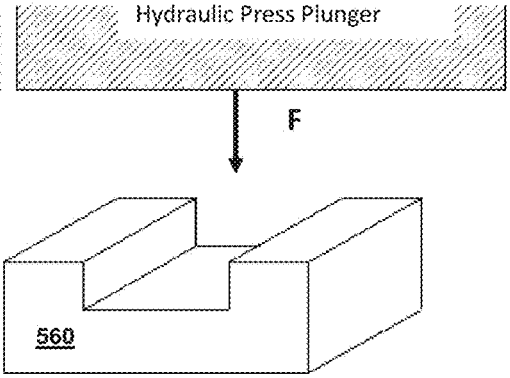

FIG. 5F shows a crystal 550 with five areas of different thickness. FIG. 5G shows a crystal 560 with three areas of different thickness. These crystals 550, 560 will produce crystal monochromators with different mosaicity in directions perpendicular to the compression force after plastic deformation.

In the illustrated examples, the thickness profile of the crystal is only changing on one axis. However, the thickness profile of the crystals may also change along more than one axis. This may permit development of a monochromator with mosaicity distribution that has radial anisotropic gradient. In order to produce monochromator with such structure (mosaic radial anisotropic gradient), an original perfect crystal with spherical profiles on one side and flat surface on another (or spherical profiles on both a top and bottom surface) may be made. After plastic deformation at the value comparable with curves of the original circular surface, the mosaicity distribution inside the crystal will have continuous radial gradient. Such a crystalline monochromator with continuous radial gradient of mosaicity can have many uses. For example, such monochromators may be employed as large size flat "mirrors" for a source of nuclear radiation (slow neutrons, X-rays, gamma-rays) in Laue (transmission) geometry. Such a profile of mosaic distribution may increase a monochromator integral reflectivity due to the increase of its working area and add to it focusing properties.

A thin crystal wafer (e.g., with a thickness of 10 mm or less) produced from a crystal that has been compressed may be used. In one embodiment, the thin crystal wafer is attached to a thin metal foil or other flexible material (e.g., by tape, solder, glue, etc.). The thin crystal wafer is then diced into small squares with sizes in the range of between 100 μm×100 μm and 1 mm×1 mm (e.g., using a diamond blade, laser cutter, plasma cutter, etc.). Preferably the flexible thin metal foil or other flexible material is not cut. The diced crystalline monochromator wafer with radial gradient of mosaicity attached to the flexible material (e.g., tape or metal foil) can be bent in accordance with any surface shape (spherical, parabolic, for example) with desirable focusing distance without die destruction, providing the same crystallographic arrangement and small space between each small die. The foil or other flexible material with the attached diced wafer may then be attached (e.g., glued or soldered) to a solid substrate surface having a desired surface shape (e.g., spherical, cylindrical, bent, parabolic, etc.) to cause the diced crystal to have this surface shape. The diced crystal monochromator with the desired surface shape can be used as a focusing lens for incident slow neutron or X-ray beams.

Figure 6:
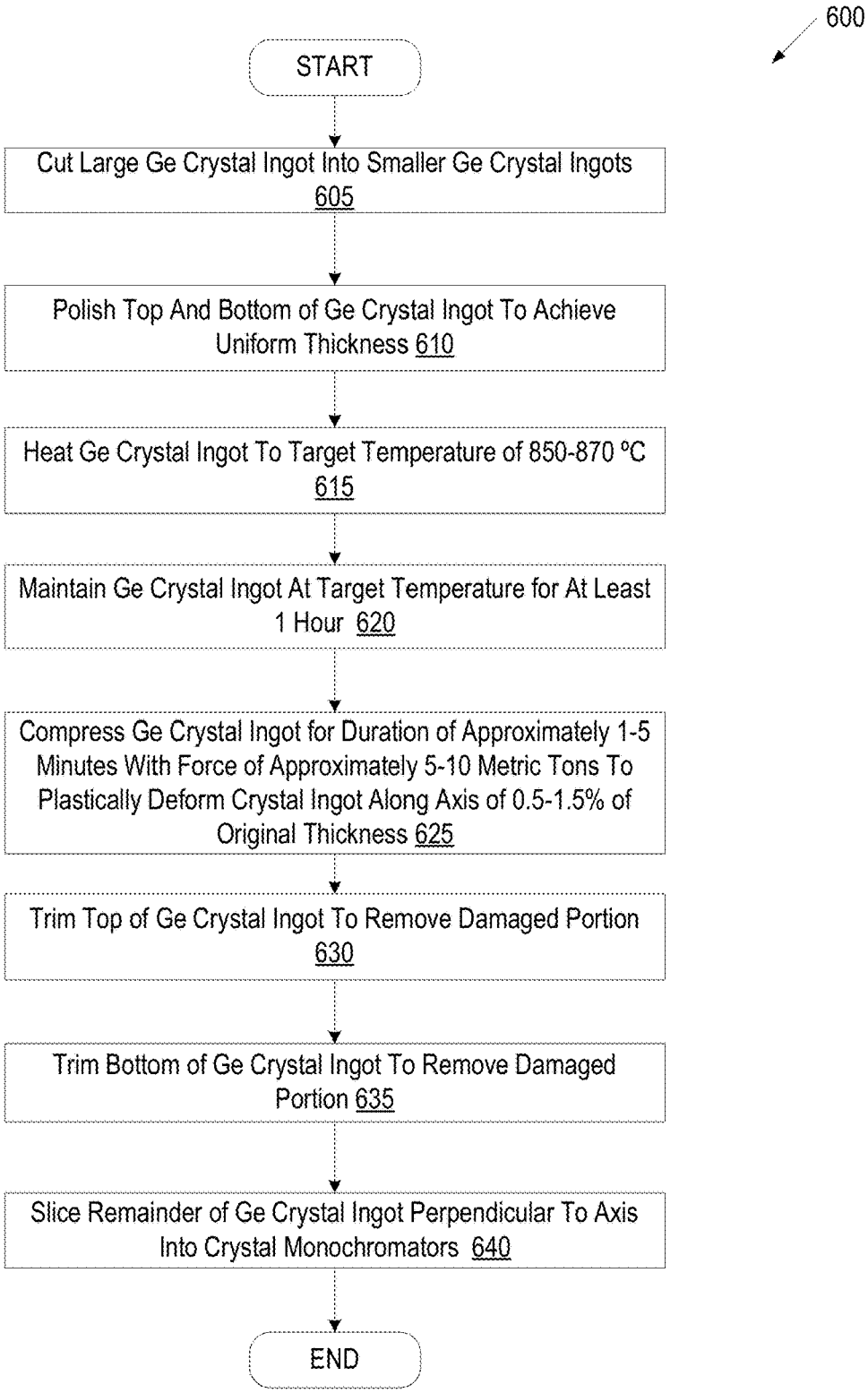
FIG. 6 is a flow chart showing a process for manufacturing a crystal monochromator, in accordance with embodiments of the present invention.

FIG. 6 is a flow chart showing a process 600 for manufacturing a Ge crystalline mosaic monochromator, in accordance with embodiments of the present invention. In method 600, a technique that the applicant refers to as dislocation doping is employed, in which plastic deformation of a perfect crystal is performed to dope the perfect crystal with dislocations which create mosaic blocks that are disoriented from the original perfect crystal structure). The operations of process 600 may be performed by various manufacturing machines, as set forth in FIG. 1.

At block 605 of method 600, a large Ge crystal ingot may be cut into smaller Ge crystal ingots. The smaller crystal ingots may be cylindrical in shape, and have a thickness of about 4 cm and a diameter of about 7 cm in one embodiment. In another embodiment, the smaller crystal ingots may be rectangular in shape, and have a thickness of about 4 cm and a width and length of about 7 cm. The smaller crystal ingots may also have other thicknesses (e.g., in the range of 40-70% of a diameter of the ingot, lengths, widths and/or diameters). For example, the Ge crystal ingot may have a thickness of 3-5 cm and a diameter of 5-10 cm.

At block 610, a top and bottom of the smaller crystal ingot may be polished to achieve a uniform thickness. In one embodiment, the top and bottom are polished so that the crystal ingot has a thickness of 3-5 cm+/−5 μm. Alternatively, if a composite crystal monochromator with multiple mosaicity values is to be produced, the top and/or bottom of the crystal may be machined to a particular surface profile. Alternatively, a top (or bottom) may be polished while the bottom (or top) is machined to have a particular profile. In one embodiment, the top and bottom are both machined to have the same surface profile. In one embodiment, the Ge ingot has a uniform thickness, but the metal plunger (or die) has a shaped surface profile to produce a composite crystal monochromator.

At block 615, the Ge ingot is heated inside a furnace to a target temperature of over 850° C. In one embodiment, the smaller ingot is heated to a temperature of about 850° C.-870° C.

At block 620, the crystal is maintained at the target temperature (e.g., measured by a thermocouple) for at least one hour. In one embodiment, the crystal is maintained at the target temperature for 1-2 hours. This ensures that the crystal reaches a uniform temperature throughout the crystal.

At block 625, the crystal is compressed for a duration of approximately 1-5 minutes with a force of approximately 5-10 metric tons to plastically deform the crystal along an axis. In one embodiment, the crystal is plastically deformed by about 0.5%-1.5%. In a further embodiment, the crystal is plastically deformed by about 1% from its original thickness.

Plastic deformation of the Ge crystal (e.g., a perfect Ge crystal having a crystallographic orientation of [1,1,1]) causes billions of small mosaic blocks to form within the crystal, each disoriented by a small amount. The deformation may be along a cylindrical axis of the Ge crystal, which may be a cylinder. Each mosaic block may be displaced from a neighbor mosaic block by a couple of millionths of an arc second. A slow neutron beam has a divergence of 20 arcminutes. Thus, a crystal with mosaicity of 20 arcminutes, when used as a monochromator for a slow neutron beam, has mosaic blocks in position that satisfy the Bragg conditions for a whole of the neutron beam.

Based on research, it appears that neutron reflectivity of a mosaic crystal is dependent on a size of mosaic blocks that are disoriented. Previous attempts to create crystalline mosaic monochromators produced relatively large sized mosaic blocks having sizes on the order of 5-10 microns. These relatively large sized mosaic blocks exhibit self-absorption of incident neutrons as a result of diffraction between the mosaic blocks, thus decreasing a reflectivity of the crystalline mosaic monochromators. However, embodiments provided herein cause an optimized mosaic block size (e.g., of about 1-5 microns) in order to decrease secondary extinction. The smaller mosaic blocks exhibit a much lower absorption of an incident and reflected neutron beam, thus increasing neutron reflectivity at the rocking curve peak. In one embodiment, the temperature and time of treatment used in embodiments herein optimizes a mosaic block size. As a result, the decrease in reflectivity that traditionally accompanies increases in mosaicity is largely ameliorated.

At block 630, a top of the crystal is trimmed after high temperature deformation. At block 635 a bottom of the crystal is also trimmed after high temperature deformation. The top and bottom may be trimmed approximately perpendicular to an axis (e.g., [1,1,1]) along which the crystal was plastically deformed. In one embodiment, at least 7 mm (e.g., about 7-10 mm) of material thickness is trimmed from the top and bottom.

At block 640, a remainder of the crystal is sliced perpendicular to the axis along which the crystal was plastically deformed to produce multiple crystal monochromators. Each of the crystal monochromators may have a thickness of about 7-10 mm in one embodiment. In a further embodiment, at least some crystal monochromators have a thickness of about 7 mm. However, thicker or thinner crystal monochromators may also be created. For example, a diced monochromator with a thickness of about 10 mm or less may be created to enable flexing of the monochromator to achieve a desired shape. The monochromators may additionally have a diameter (or width and length) that is equal to the original diameter (or width and length) of the crystal or may be diced to have any smaller diameter (or width and/or length).

Depending on the force applied during compression, the temperature of the crystal during compression, and/or the duration of the compression, a range of reflectivity and mosaicity properties is achievable for manufactured Ge crystalline mosaic monochromators.

TABLE 1

Mosaicity and Slow Neutron Peak Rocking Curve Reflectivity for Ge Crystal Samples

| Sample # | Mosaicity | Reflectivity In Peak of Rocking Curve |
|---|---|---|
| 1 | 16' | 89% |
| 2 | 15' | 88.7% |
| 3 | 28' | 89.5% |
| 4 | 28' | 77.1% |
| 5 | 22' | 76% |
| 6 | 19' | 87.8% |
| 7 | 18.5' | 89% |
| 8 | 17' | 77.9% |
| 9 | 16.5' | 79.9% |

Table 1 shows mosaicity and peak rocking curve reflectivity values for samples of various Ge crystals. All values are measured using a slow neutron beam with a wavelength of $\lambda$=1.52 angstroms. The sample 3 crystal monochromator manufactured in accordance with an embodiment has a mosaicity of 28.5 arcminutes and a slow neutron rocking curve peak reflectivity (peak reflectivity at Bragg angle) of 89.5%. The sample 6 crystal monochromator manufactured in accordance with one embodiment has a mosaicity of 19 arcminutes and a slow neutron rocking curve peak reflectivity of 87.8%. The divergence of a slow neutron beam for some reactors is about 20 arcminutes. Thus, by manufacturing a crystal monochromator with a mosaicity of about 20 arcminutes and a high reflectivity of up to about 89-90%, a maximum amount of a neutron flux may be reflected and used. Crystal monochromators described in embodiments herein permit a heretofore unattainable amount of neutron flux of a slow neutron beam to be used. Thus these crystal monochromators may be useful for slow neutron monochromatization in research and other applications.

Figure 7A:
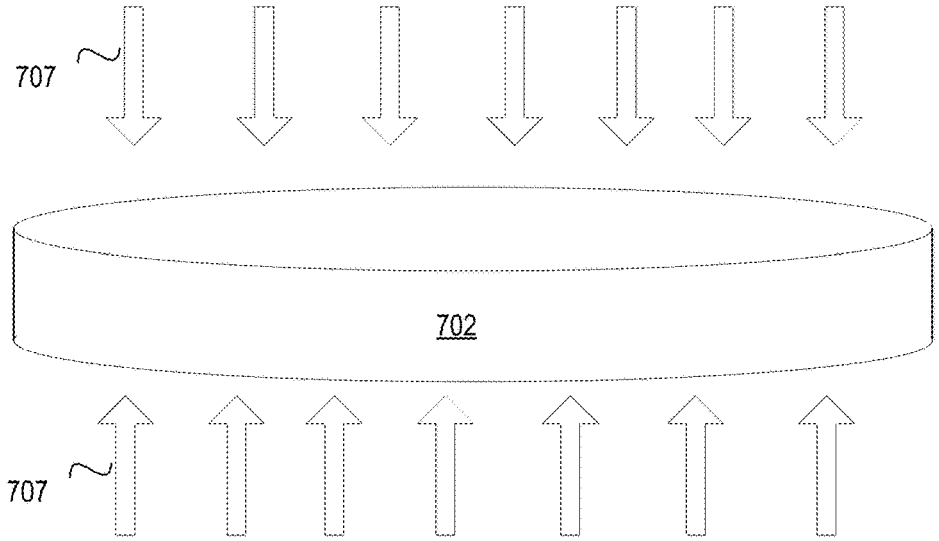
FIGS. 7A-7D illustrate a crystal during various steps of a manufacturing process for a crystal monochromator.

FIGS. 7A-7D illustrate a crystal during various steps of a manufacturing process for a crystal monochromator. FIG. 7A illustrates a starting crystal 702, which may be a perfect Ge crystal in one embodiment. The starting crystal 702 may be polished on a top and bottom to ensure a uniform thickness. The starting crystal 702 may then be compressed by compressive forces 707 at a temperature of about 850° C.-870° C. at a force of about 5-10 metric tons to plastically deform the starting crystal 702. Compressive forces 707 may be applied along a crystal which is along a [1,1,1] axis to cause uniform plastic deformation across the crystal.

Figure 7B:
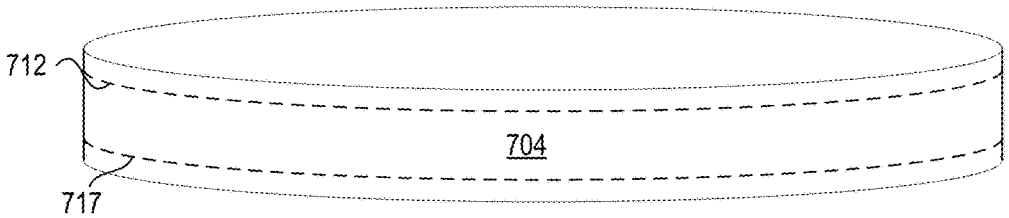

FIG. 7B illustrates a plastically deformed crystal 704 that has a plastic deformation of about 0.5%-1.5% from a starting thickness. In one embodiment, the plastic deformation is approximately 1% from the starting thickness. The plastic deformation process damages the crystal near the top and bottom, causing large and non-uniform undesirable mosaicity. Accordingly, the top and bottom of the plastically deformed crystal 704 may be trimmed by removing about 7-10 mm. In one embodiment, a minimum of 7 mm of material is trimmed from the top and bottom of the plastically deformed crystal 704. In one embodiment, the plastically deformed crystal 704 is trimmed along a trim line that is perpendicular to the direction of compression (to the axis on which the plastically deformed crystal was deformed). Trim line 712 shows a top portion of the plastically deformed crystal 704 that is removed and trim line 717 shows a bottom portion of the plastically deformed crystal 704 that is removed.

Figure 7C:
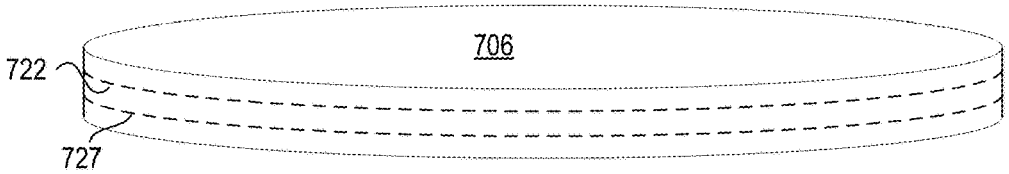

FIG. 7C illustrates a remainder 706 of the plastically deformed crystal after the top and bottom portions have been removed. The remainder 706 of the plastically deformed crystal is sliced approximately perpendicular to the axis along which compression occurred. As shown, the remainder 706 of the plastically deformed crystal is sliced along cut lines 722 and 727. Though only two cut lines are shown, many more cut lines may be used to slice the crystal into multiple discs or wafers. Each such Ge disc with a thickness of 7-10 mm is a crystal monochromator with a mosaicity of between about 15-28 arcminutes and a slow neutron reflectivity of over 70% at a rocking curve peak.

Figure 7D:
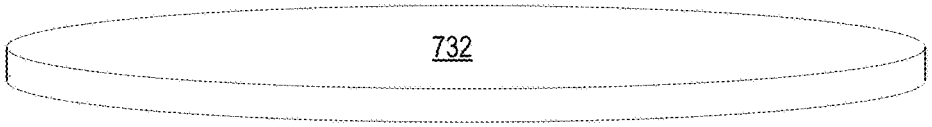

FIG. 7D illustrates one resultant crystal monochromator 732.

The preceding description sets forth numerous specific details such as examples of specific systems, components, methods, and so forth, in order to provide a good understanding of several embodiments of the present invention. It will be apparent to one skilled in the art, however, that at least some embodiments of the present invention may be practiced without these specific details. In other instances, well-known components or methods are not described in detail or are presented in simple block diagram format in order to avoid unnecessarily obscuring the present invention. Thus, the specific details set forth are merely exemplary. Particular implementations may vary from these exemplary details and still be contemplated to be within the scope of the present invention.

Reference throughout this specification to "one embodiment" or "an embodiment" means that a particular feature, structure, or characteristic described in connection with the embodiment is included in at least one embodiment. Thus, the appearances of the phrase "in one embodiment" or "in an embodiment" in various places throughout this specification are not necessarily all referring to the same embodiment. In addition, the term "or" is intended to mean an inclusive "or" rather than an exclusive "or."

Although the operations of the methods herein are shown and described in a particular order, the order of the operations of each method may be altered so that certain operations may be performed in an inverse order or so that certain operation may be performed, at least in part, concurrently with other operations. In another embodiment, instructions or sub-operations of distinct operations may be in an intermittent and/or alternating manner.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A crystal monochromator comprising:

a Ge crystal body, wherein at least a first region of the Ge crystal body comprises a mosaic structure having a mosaicity of between about 15 arcminutes to about 28 arcminutes and a slow neutron reflectivity of about 70%-89% at a rocking curve peak.

2. The crystal monochromator of claim 1, wherein the slow neutron reflectivity is about 75%-89% at the rocking curve peak.

3. The crystal monochromator of claim 1, wherein the Ge crystal body has a thickness of about 7-10 mm cut from a plastically deformed ingot.

4. The crystal monochromator of claim 1, wherein the mosaic structure is approximately uniform over the Ge crystal body.

5. The crystal monochromator of claim 1, wherein the Ge crystal body comprises:

the first region having the mosaicity of between about 15-28 arcminutes; and a second region having a mosaicity of less than 15 arcminutes.

6. The crystal monochromator of claim 5, wherein the Ge crystal body comprises a continuous gradient of mosaicity between the first region and the second region along at least one axis.

7. The crystal monochromator of claim 5, wherein the second region has an approximately perfect crystal structure with a mosaicity of less than approximately 1 arcminute.

8. The crystal monochromator of claim 1, wherein the Ge crystal body comprises a plastically deformed Ge crystal with a planar orientation of (1,1,1).

9. A method of manufacturing a crystal monochromator, comprising:

heating an approximately perfect Ge crystal having an original thickness of approximately 3-5 cm to a temperature of over about 850° C.;

compressing the Ge crystal for a duration of approximately 1-5 minutes with a force of about 5-10 metric tons while the Ge crystal is maintained at the temperature of over about 850° C. to plastically deform the Ge crystal along an axis of the Ge crystal, wherein the compressing causes a plastic deformation of about 0.5%-1.5% of the original thickness; and slicing the Ge crystal to form a plurality of crystal monochromators, wherein at least a first region of each of the plurality of crystal monochromators has a first mosaicity value of between about 15-28 arcminutes and a slow neutron reflectivity of about 70%-89% at a peak rocking curve.

10. The method of claim 9, further comprising polishing a top and a bottom of the Ge crystal prior to the heating and compressing to cause the Ge crystal to have an approximately uniform thickness of 3-5 cm+/−5 μm.

11. The method of claim 9, wherein the Ge crystal comprises an approximately perfect Ge crystal with a planar orientation of (1,1,1).

12. The method of claim 9, further comprising:

trimming at least about 7 mm off of a top of the Ge crystal after the compressing and before the slicing; and trimming at least about 7 mm off of a bottom of the Ge crystal after the compressing and before the slicing;

wherein slicing the Ge crystal comprises slicing a remainder of the Ge crystal perpendicular to the axis of the Ge crystal to form the plurality of crystal monochromators.

13. The method of claim 12, wherein each of the plurality of crystal monochromators has a thickness of about 7-9 mm.

14. The method of claim 9, wherein heating the Ge crystal to the temperature of over about 850° C. comprises:

heating the Ge crystal to a temperature of about 855° C.-870° C.; and maintaining the Ge crystal at the temperature of about 855° C.-870° C. for a period of at least 1 hour prior to compressing the Ge crystal.

15. The method of claim 9, wherein compressing the Ge crystal with the force of about 5-10 metric tons comprises:

applying a first force to the first region of the Ge crystal to cause the first region to have the first mosaicity of between about 15-28 arcminutes; and applying a second force to a second region of the Ge crystal to cause the second region to have a second mosaicity that is lower than the first mosaicity.

16. The method of claim 15, further comprising:

shaping a top surface of the Ge crystal to cause the top surface to have a surface profile wherein the first region is thicker than the second region; and shaping a bottom surface of the Ge crystal to cause the bottom surface to have the surface profile.

17. The method of claim 15, further comprising:

shaping a surface of a first metal die used to contact a top of the Ge crystal during compression to cause the surface of the first metal die to have a surface profile wherein a first region of the metal die is thicker than a second region of the metal die; and shaping a surface of a second metal die used to contact a bottom of the Ge crystal during the compression to cause the surface of the second metal die to have the surface profile.

18. A crystal monochromator manufactured by a process comprising:

heating an approximately perfect Ge crystal having an original thickness of approximately 3-5 cm to a temperature of over about 850° C.;

compressing the Ge crystal for a duration of approximately 1-5 minutes with a force of about 5-10 metric tons while the Ge crystal is maintained at the temperature of over about 850° C. to plastically deform the Ge crystal along an axis of the Ge crystal, wherein the compressing causes a plastic deformation of about 0.5%-1.5% of the original thickness; and slicing the Ge crystal to form a plurality of crystal monochromators, wherein at least a first region of each of the plurality of crystal monochromators has a first mosaicity value of between about 15-28 arcminutes and a slow neutron reflectivity of about 70%-89% at a rocking curve peak.

19. The crystal monochromator of claim 18, wherein the process further comprises:

trimming at least about 7 mm off of a top of the Ge crystal after the compressing and before the slicing; and trimming at least about 7 mm off of a bottom of the Ge crystal after the compressing and before the slicing;

wherein slicing the Ge crystal comprises slicing a remainder of the Ge crystal perpendicular to the axis of the Ge crystal to form the plurality of crystal monochromators each having thicknesses of about 7-9 mm.

20. A crystal monochromator, comprising:

a Ge crystal body comprising a first region with a first mosaicity value; and the Ge crystal body comprising a second region with a second mosaicity value that is higher than the first mosaicity value and a slow neutron reflectivity of about 70%-89% at a rocking curve peak.

21. The crystal monochromator of claim 20, wherein the first region has an approximately perfect crystal structure with a mosaicity of less than about 1 arcminute and the second region has a mosaicity of less than about 40 arcminutes.

22. The crystal monochromator of claim 20, wherein the Ge crystal body comprises a continuous gradient of mosaicity between the first region and the second region along at least one axis.

23. The crystal monochromator of claim 22, wherein the first region is an inner circular region of the monochromator, wherein the second region is an outer circular region of the monochromator that is concentric with the inner circular region, and wherein the continuous gradient is a radial gradient between the inner circular region and the outer circular region.

* * * * *